US007624987B2

(12) United States Patent
Campbell et al.

(10) Patent No.: US 7,624,987 B2
(45) **Date of Patent: *Dec. 1, 2009**

(54) BIASED CARD DEAL

(75) Inventors: Darrell D. Campbell, Buffalo Gap, SD (US); David Richards, Las Vegas, NV (US); Spencer Peterson, Henderson, NV (US)

(73) Assignee: Seven Generations, Inc., Buffalo Gap, SD (US)

( * ) Notice: Subject to any disclaimer, the term of this patent is extended or adjusted under 35 U.S.C. 154(b) by 473 days.

This patent is subject to a terminal disclaimer.

(21) Appl. No.: 11/348,994

(22) Filed: Feb. 6, 2006

(65) Prior Publication Data

US 2006/0125182 A1 Jun. 15, 2006

Related U.S. Application Data

(62) Division of application No. 10/681,797, filed on Oct. 8, 2003, now Pat. No. 7,422,215.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS

| | | | |
|---|---|---|---|
| 3,663,021 | A | 5/1972 | Whippo |
| 4,305,586 | A | 12/1981 | Richards |
| 4,397,469 | A | 8/1983 | Carter |
| 4,440,398 | A | 4/1984 | Charon |
| 4,648,604 | A | 3/1987 | Horan |
| 4,651,997 | A | 3/1987 | Wood |
| 4,836,553 | A | 6/1989 | Suttle et al. |
| 5,368,305 | A | 11/1994 | Rodda et al. |
| 5,403,015 | A | 4/1995 | Forte et al. |
| 5,518,249 | A | 5/1996 | Sines et al. |
| 5,554,892 | A | 9/1996 | Norimatsu |
| 5,586,766 | A | 12/1996 | Forte et al. |
| 5,657,993 | A | 8/1997 | Merlino et al. |
| 5,685,774 | A | 11/1997 | Webb |
| 5,788,230 | A | 8/1998 | Krise et al. |
| 5,820,128 | A | 10/1998 | Brunelle |
| 5,839,732 | A | 11/1998 | Guidi |
| 5,845,211 | A | 12/1998 | Roach, Jr. |

(Continued)

*Primary Examiner*—Gene Kim
*Assistant Examiner*—Dolores Collins
(74) *Attorney, Agent, or Firm*—Gordon & Rees, LLP

(57) ABSTRACT

In the present invention, a method is provided for biasing or controlling the deal of cards, or other indicia, to players of a game. The cards are biased such that each player in the game will receive a hand that is close in ranking to all the other players of the game. Each player of the game is assigned a deviation multiplier selected from a list. Next an initial single hand rank is randomly selected and each player's deviation number is used to identify a range of hand rankings from which each player's hand is selected. If the initial hand ranking is 50 and the average deviation for a player is 2, the player's hand ranking will be in the range of 50±(10×deviation multiplier) or 50±(20) which is 30-70. (i.e. 50±20 or 50−20=30 and 50+20=70). Biasing the deal of the cards increases the excitement and competition of the game by allowing all players of the game to have relatively close hand rankings.

12 Claims, 7 Drawing Sheets

U.S. PATENT DOCUMENTS 5,845,907 A 12/1998 Wells
5,928,082 A 7/1999 Clapper, Jr.
5,934,672 A 8/1999 Sines et al.
5,934,998 A 8/1999 Forte et al.
5,951,011 A 9/1999 Potter et al.
5,997,002 A 12/1999 Goldman
6,015,347 A 1/2000 Maahs et al.
6,019,374 A 2/2000 Breeding
6,029,976 A 2/2000 Brunelle
6,056,641 A 5/2000 Webb
6,089,976 A 7/2000 Schneider et al.
6,102,400 A 8/2000 Scott et al.
6,102,402 A 8/2000 Scott et al.
6,102,403 A 8/2000 Kaufman
6,105,964 A 8/2000 Maahs
6,158,741 A 12/2000 Koelling
6,164,069 A 12/2000 Takahashi et al.
6,179,290 B1 1/2001 Maahs
6,189,888 B1 2/2001 Brunelle
6,196,547 B1 3/2001 Pascal et al.
6,203,009 B1 3/2001 Sines et al.
6,210,277 B1 4/2001 Stefan
6,229,534 B1 5/2001 Gerra et al.
6,237,916 B1 5/2001 Webb
6,270,079 B1 8/2001 Chamberlain
6,270,404 B2 8/2001 Sines et al.
6,299,532 B1 10/2001 Smith
6,325,375 B1 12/2001 Potter et al.
6,334,614 B1 1/2002 Breeding
6,345,823 B1 2/2002 Webb
6,402,147 B1 6/2002 Lo
6,406,024 B1 6/2002 Perkins
6,419,225 B2 7/2002 Sines et al.
6,419,226 B2 7/2002 Krise et al.
6,435,506 B1 8/2002 Piccoli
6,446,972 B1 9/2002 Brunelle
6,481,718 B2 11/2002 Koelling
6,517,073 B1 2/2003 Vancura
6,588,758 B1 7/2003 Lee
6,607,195 B2 8/2003 Vancura
6,619,659 B2 9/2003 Krise et al.
6,641,137 B2 11/2003 Sines et al.
6,644,666 B1 11/2003 Tamura et al.
6,651,985 B2 11/2003 Sines et al.
6,698,759 B2 3/2004 Webb et al.
6,722,974 B2 4/2004 Sines et al.
6,773,012 B1 8/2004 French
6,800,028 B1 10/2004 Paludi
6,802,774 B1 10/2004 Carlson et al.
6,857,957 B2 2/2005 Marks et al.
6,923,446 B2 8/2005 Snow
6,938,900 B2 9/2005 Snow
7,422,215 B2 * 9/2008 Campbell et al. ..... 273/292

* cited by examiner

| HAND RANK | HIGH CARD |
|---|---|
| 1 | 7 HI |
| 2 | 8 HI |
| 3 | 9 HI |
| 4 | 10 HI |
| 5 | JACK HI |
| 6 | QUEEN HI |
| 7 | KING HI |
| 8 | ACE HI |

FIG. 1a

| HAND RANK | PAIR |
|---|---|
| 9 | PAIR 2s |
| 10 | PAIR 3s |
| 11 | PAIR 4s |
| 12 | PAIR 5s |
| 13 | PAIR 6s |
| 14 | PAIR 7s |
| 15 | PAIR 8s |
| 16 | PAIR 9s |
| 17 | PAIR 10s |
| 18 | PAIR JACKS |
| 19 | PAIR QUEENS |
| 20 | PAIR KINGS |
| 21 | PAIR ACES |

FIG. 1b

| HAND RANK | 2 PAIR |
|---|---|
| 22 | 2 PAIR 3 HI |
| 23 | 2 PAIR 4 HI |
| 24 | 2 PAIR 5 HI |
| 25 | 2 PAIR 6 HI |
| 26 | 2 PAIR 7 HI |
| 27 | 2 PAIR 8 HI |
| 28 | 2 PAIR 9 HI |
| 29 | 2 PAIR 10 HI |
| 30 | 2 PAIR JACK HI |
| 31 | 2 PAIR QUEEN HI |
| 32 | 2 PAIR KING HI |
| 33 | 2 PAIR ACE HI |

FIG. 1c

| HAND RANK | 3 OF A KIND |
|---|---|
| 34 | 3 KIND 2 HI |
| 35 | 3 KIND 3 HI |
| 36 | 3 KIND 4 HI |
| 37 | 3 KIND 5 HI |
| 38 | 3 KIND 6 HI |
| 39 | 3 KIND 7 HI |
| 40 | 3 KIND 8 HI |
| 41 | 3 KIND 9 HI |
| 42 | 3 KIND 10 HI |
| 43 | 3 KIND JACK HI |
| 44 | 3 KIND QUEEN HI |
| 45 | 3 KIND KING HI |
| 46 | 3 KIND ACE HI |

FIG. 1d

| HAND RANK | STRAIGHT |
|---|---|
| 47 | STR 5 HI |
| 48 | STR 6 HI |
| 49 | STR 7 HI |
| 50 | STR 8 HI |
| 51 | STR 9 HI |
| 52 | STR 10 HI |
| 53 | STR JACK HI |
| 54 | STR QUEEN HI |
| 55 | STR KING HI |
| 56 | STR ACE HI |

FIG. 1e

| HAND RANK | FLUSH |
|---|---|
| 57 | FLUSH 7 HI |
| 58 | FLUSH 8 HI |
| 59 | FLUSH 9 HI |
| 60 | FLUSH 10 HI |
| 61 | FLUSH JACK HI |
| 62 | FLUSH QUEEN HI |
| 63 | FLUSH KING HI |
| 64 | FLUSH ACE HI |

FIG. 1f

| HAND RANK | FULL HOUSE |
|---|---|
| 65 | FULL HOUSE 2 HI |
| 66 | FULL HOUSE 3 HI |
| 67 | FULL HOUSE 4 HI |
| 68 | FULL HOUSE 5 HI |
| 69 | FULL HOUSE 6 HI |
| 70 | FULL HOUSE 7 HI |
| 71 | FULL HOUSE 8 HI |
| 72 | FULL HOUSE 9 HI |
| 73 | FULL HOUSE 10 HI |
| 74 | FULL HOUSE JACK HI |
| 75 | FULL HOUSE QUEEN HI |
| 76 | FULL HOUSE KING HI |
| 77 | FULL HOUSE ACE HI |

FIG. 1g

| HAND RANK | 4 OF A KIND |
|---|---|
| 78 | 4K 2 HI |
| 79 | 4K 3 HI |
| 80 | 4K 4 HI |
| 81 | 4K 5 HI |
| 82 | 4K 6 HI |
| 83 | 4K 7 HI |
| 84 | 4K 8 HI |
| 85 | 4K 9 HI |
| 86 | 4K 10 HI |
| 87 | 4K JACK HI |
| 88 | 4K QUEEN HI |
| 89 | 4K KING HI |
| 90 | 4K ACE HI |

FIG. 1h

| HAND RANK | STRAIGHT FLUSH |
|---|---|
| 91 | STR FL 5 HI |
| 92 | STR FL 6 HI |
| 93 | STR FL 7 HI |
| 94 | STR FL 8 HI |
| 95 | STR FL 9 HI |
| 96 | STR FL 10 HI |
| 97 | STR FL JACK HI |
| 98 | STR FL QUEEN HI |
| 99 | STR FL KING HI |
| 100 | STR FL ACE HI |

FIG. 1i

| Number of Players | Average Deviation (+ or -) |
|---|---|
| 2 | 1,2 |
| 3 | 1,1,2 |
| 4 | 1,1,2,3 |
| 5 | 1,1,2,2,3 |
| 6 | 1,1,2,2,2,3 |
| 7 | 1,1,2,2,2,3,3 |
| 8 | 1,1,1,2,2,2,3,3 |

FIG. 3

Initial Hank Rank
3 KIND 7 HI

Player 1
Aver. Dev.:
1
Hand Rank Range:
2 PAIR 10 HI to STR 7 HI

Player 2
Aver. Dev.:
2
Hand Rank Range:
PAIR QUEENS to FLUSH 9 HI

Player 3
Aver. Dev.:
1
Hand Rank Range:
2 PAIR 10 HI to STR 7 HI

Player 4
Aver. Dev.:
3
Hand Rank Range:
PAIR 2s to FULL HOUSE 6 HI

FIG. 4a

Initial Hand Rank
3 KIND 7 HI

Player 1
Aver. Dev.:
1
Hand Rank Range:
2 PAIR 10 HI to STR 7 HI
Hand Rank:
2 PAIR QUEEN H1

Player 2
Aver. Dev.:
2
Hand Rank Range:
PAIR QUEENS to FLUSH 9 HI
Hand Rank:
3 KIND JACK HI

Player 3
Aver. Dev.:
1
Hand Rank Range:
2 PAIR 10 HI to STR 7 HI
Hand Rank:
2 PAIR ACE HI

Player 4
Aver. Dev.:
3
Hand Rank Range:
PAIR 2s to FULL HOUSE 6 HI
Hand Rank:
FLUSH 7 HI

FIG. 4b

Initial Hand Rank
FULL HOUSE 9 HI

Player 1
Aver. Dev.:
2
Hand Rank Range:
STR 10 HI to STR FL 6 HI

Player 2
Aver. Dev.:
1
Hand Rank Range:
FLUSH QUEEN HI to 4K 6 HI

Player 3
Aver. Dev.:
3
Hand Rank Range:
3K 10 HI to STR FL ACE HI

Player 4
Aver. Dev.:
1
Hand Rank Range:
FLUSH QUEEN HI to 4K 6 HI

Player 5
Aver. Dev.:
2
Hand Rank Range:
STR 10 HI to STR FL 6 HI

Player 6
Aver. Dev.:
2
Hand Rank Range:
STR 10 HI to STR FL 6 HI

FIG. 5a

Initial Hank Rank
FULL HOUSE 9 HI

Player 1
Aver. Dev.:
2
Hand Rank Range:
STR 10 HI to STR FL 6 HI
Hand Rank:
FULL HOUSE 3 HI

Player 2
Aver. Dev.:
1
Hand Rank Range:
FLUSH QUEEN HI to 4K 6 HI
Hand Rank:
4K 2 HI

Player 3
Aver. Dev.:
3
Hand Rank Range:
3K 10 HI to STR FL ACE HI
Hand Rank:
STR FL QUEEN HI

Player 4
Aver. Dev.:
1
Hand Rank Range:
FLUSH QUEEN HI to 4K 6 HI
Hand Rank:
FLUSH QUEEN HI

Player 5
Aver. Dev.:
2
Hand Rank Range:
STR 10 HI to STR FL 6 HI
Hand Rank:
FULL HOUSE ACE HI

Player 6
Aver. Dev.:
2
Hand Rank Range:
STR 10 HI to STR FL 6 HI
Hand Rank:
FLUSH 10 HI

FIG. 5b

BIASED CARD DEAL

CROSS REFERENCE TO RELATED APPLICATIONS

This application is a divisional of prior application Ser. No. 10/681,797 filed Oct. 8, 2003 now U.S. Pat. No. 7,422,215.

FIELD OF THE INVENTION

The invention relates to a method of controlling the deal of cards, or other indicia, to players of a card game.

BACKGROUND OF THE INVENTION

When playing a game of cards, the cards must be dealt to each of the players. The most common method of dealing cards for a game requires shuffling the cards and subsequently dealing the cards to each of the players in the game. Cards are shuffled prior to dealing the cards ensuring a random distribution of the cards through out the deck of cards and to the players. For example, in standard five-card stud poker utilizing a random deal, the cards are shuffled to insure a random distribution of the cards through out the deck. Once the cards have been thoroughly shuffled, the cards are then dealt to each player in the game.

When all players have been dealt the proper number of cards for the card game that they are playing, the hand rank of each player is determined by the probability of cards occurring in his hand. For example, the probability of the first card dealt to a player from a fifty-two card deck being the Ace of Spades is 1 in 52. The probability of the next card being the Ace of Diamonds is 1 in 51. The probability of the third card dealt being the Ace of Heart is 1 in 50, etc. Randomly dealing cards makes it extremely difficult for multiple players to have hands that are competitively ranked within the same game. Typically, most players in the game are dealt hands that have low rankings which causes them to fold their hands prior to the end of the game or they will lose the game.

Randomly dealing cards results in a less exciting and a less competitive card game, such as poker, where each of the players have varying hand ranks associated with their cards. One player may have an exceptional hand while the remaining players have hands that are not very highly ranked. As a result, the winner of the game is determined by the deal of the cards and the other players have no chance in winning. A method of biasing or controlling the deal of the cards is needed to increase the excitement and competition of the game. By utilizing a biased or controlled deal in a game allows for all players of the game to have relatively close hand rankings within the game. Therefore, the excitement of the game will be increased as the players know that all hands are relatively close in rank to each other, but do not know if they have the best hand or only a good hand.

SUMMARY OF THE INVENTION

It is an object of the present invention to provide a method of biasing or controlling the deal of cards, or other indicia, utilized in a game such as poker.

It is another object of the present invention to utilize statistical sampling of all possible hands or combinations in determining the hand of each player of the game.

It is yet another object of the present invention to provide for a more exciting game by keeping the hand rankings of all the players in the game close together.

In the present invention, a method is provided for biasing or controlling the deal of cards, or other indicia, to players of a game. The cards are biased such that each player in the game will receive a hand that is close in ranking to all the other players of the game. Each player of the game is assigned a deviation multiplier selected from a list. Next an initial single hand rank is randomly selected and each player's deviation number is used to identify a range of hand rankings from which each player's hand is selected. If the initial hand ranking is 50 and the average deviation for a player is 2, the player's hand ranking will be in the range of 50±(10× deviation multiplier) or 50±(20) which is 30-70. (i.e. 50±20 or 50−20=30 and 50+20=70). Biasing the deal of the cards increases the excitement and competition of the game by allowing all players of the game to have relatively close hand rankings.

The foregoing, together with other features and advantages of the present invention, will become more apparent when referring to the following specification, claims and accompanying drawings.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which:

FIG. 1*a* illustrates the hand rankings of a high card;

FIG. 1*b* illustrates the hand rankings of a pair;

FIG. 1*c* illustrates the hand rankings of two pair;

FIG. 1*d* illustrates the hand rankings of three of a kind;

FIG. 1*e* illustrates the hand rankings of a straight;

FIG. 1*f* illustrates the hand rankings of a flush;

FIG. 1*g* illustrates the hand rankings of a full house;

FIG. 1*h* illustrates the hand rankings of four of a kind;

FIG. 1*i* illustrates the hand rankings of a straight flush;

FIG. 3 illustrates a list of deviation multipliers;

FIG. 4*a* illustrates an example of a game of five card stud played with four players;

FIG. 4*b* illustrates the hand rank selected for each of the four players for the game in FIG. 4*a;*

FIG. 5*a* illustrates an example of a game of five card stud played with six players; and FIG. 5*b* illustrates the hand rank selected for each of the six players of the game in FIG. 5*a*.

DETAILED DESCRIPTION OF THE DRAWINGS

Figure 2:
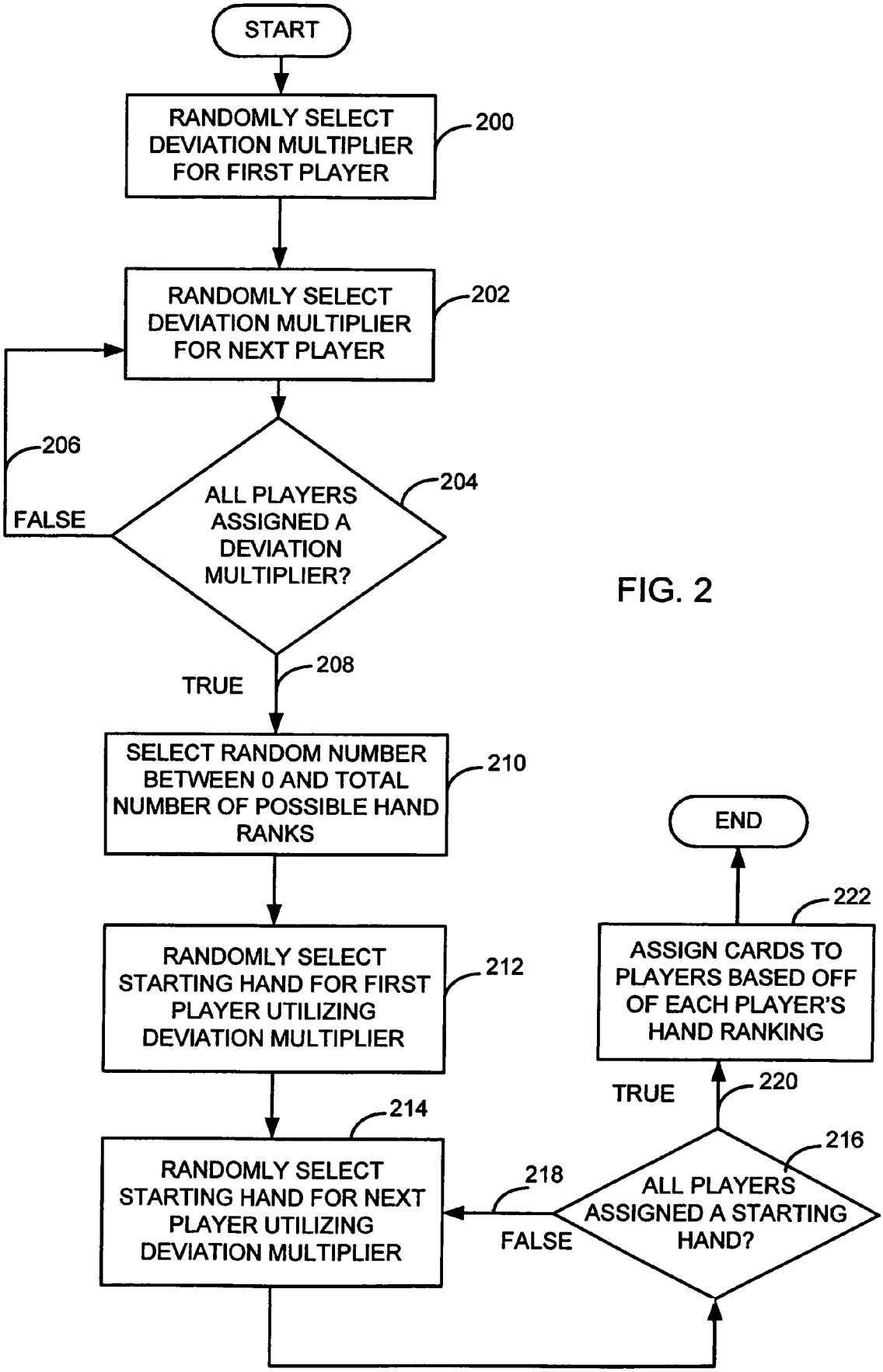
FIG. 2 is a flow chart illustrating the method of biasing or controlling the deal of cards in accordance with the present invention.

The present invention is a method of biasing or controlling how cards are dealt from a standard deck or decks of cards by utilizing a set of rules that can be implemented in numerous physical or electronic forms, in numerous settings and in numerous variations. The following detailed description illustrates a preferred embodiment of the present invention. In the preferred embodiment, the method of biasing or controlling how the cards are dealt utilizes a variety of electronic video poker games which are designed to display the hand of each player on a video screen. Typically, buttons located on the video games are utilized by players to select cards to play, select cards which are to be moved from one location to another and which cards to discard. In an alternative embodiment, the screen can be conventional touch screen technology. The biased card deal of the present invention is implemented as part of a five card stud poker game utilizing a video game in the preferred embodiment. Those skilled in the art will recognize that the principles and teachings described herein may be applied to a variety of other card games, with or without the use of a video game.

In a card game, such as five card stud, there exists a finite number of hands that may be dealt to a player using a standard deck of cards. Each of these hands is assigned a hand rank which is well known within the gaming industry. These hand rankings, illustrated in FIGS. 1*a-i,* are used to determine the winner of the game. As can be seen in FIGS. 1*a-i,* the hands are identified by the value or rank of each hand and the cards in each hand. Hands are ranked between 1 and 100 with 100 being the best hand and 1 being the worst hand. Additionally, the hand rankings are broken up in to the various poker hands that players may be dealt. These pokers hands, from highest to lowest, are: straight flush, four of a kind, full house, flush, straight, three of a kind, 2 pair, pair and high card. Within each poker hand, there are several variations that a player may be dealt. For example, once all the cards are dealt, and the player has a pair, the player can have a pair of 2s, a pair of 3s, a pair of 4s, etc. As discussed previously, each possible hand that may be dealt to a player is assigned a hand rank. As illustrated in FIG. 1*b,* a pair of 2s has a hand rank of 9 while a pair of 10s has a hand rank of 17. FIG. 1*a* illustrates the hand rankings of all the possibilities of a high card, FIG. 1*c* illustrates the hand rankings of all the possibilities of a 2 pair, FIG. 1*d* illustrates the hand rankings of all the possibilities of a three of a kind, FIG. 1*e* illustrates the hand rankings of all the possibilities of a straight, FIG. 1*f* illustrates the hand rankings of all the possibilities a flush, FIG. 1*g* illustrates the hand rankings of all the possibilities of a full house. FIG. 1*h* illustrates the hand rankings of all the possibilities of a four of a kind and FIG. 1*i* illustrates the hand rankings of all the possibilities of a straight flush.

Turning to FIG. 2, a flow chart illustrating the method of biasing or controlling the deal of cards of the present invention is shown. In this method, a deviation multiplier is randomly selected for a first player in a card game from a list of deviation multipliers at step 200. A deviation multiplier is a number which is utilized to identify a range of hand ranks from which a hand ranking will be selected for each player of the game. Next, a deviation multiplier is randomly selected for a second player in the card game at step 202. A check is then made to determine if all the players in the game have been assigned a deviation multiplier at step 204. If the answer is FALSE 206, the process in step 202 is repeated until all players have received a deviation multiplier. If the answer is TRUE 208, a random number is selected between 0 and the total number of possible hand rankings for the game, i.e. 0 and 100, as shown in step 210. The random number that is selected represents an initial single hand rank which is used to determine the individual hand for each player. An example of a list of deviation multipliers is illustrated in FIG. 3. This list is by way of example only and different deviation multipliers may be chosen for each group of players. As shown in FIG. 3, if there are two players in the game, the deviation multipliers will be a one and a two, if there are four players in the game, the deviations multipliers will be one, one, two and four. The deviation multipliers are randomly assigned to each of the players in the game.

As described previously, once the initial single hand rank has been selected, the first player's hand is then determined using the initial single hand rank. Each player's hand will be within a range of ±(10× deviation multiplier) of the initial single hand rank. In other words, if the initial hand rank is 50 and the deviation multiplier is 1, the range of possible hand ranking for the player is ±(10×1)=±10 of the initial single hand rank. Therefore, the range is 50±10 or a range of 40 to 60. The hand is selected by using a formula defined by the method in the preferred embodiment. The following formula is utilized:

$$(10\times \text{ player's deviation multiplier})\times 2$$

Although this formula is illustrated, additional formulas may be utilized in this method, such as multiplying by 3 and not 2. Using this formula (10×deviation multiplier)×2, a random number is selected and the random number chosen is added to the initial single hand rank to establish a base number. Then the player's deviation multiplier is multiplied by 10 and this value is subtracted from the base number 212. For example, in step 210 the number 50 is randomly selected which represents the initial single hand rank and the deviation multiplier assigned to a player is 2. Next, as indicated in step 212, a random number from 0 to (10× player's deviation multiplier)×2 (i.e. 0 to (10×2)×2 or 0 to 40) is selected. If the number 5 is randomly selected, the number 5 is added to the initial hand rank (50+5=55) so that 55 becomes the base number. Then (10× player's deviation multiplier) is subtracted from the base number or 55 (i.e., 10×2=20). In other words, 20 (i.e., 10×2) is subtracted from 55 for a value of 35 which represents the hand rank of the first player. 35 is a hand of 3 of a kind 3 high Next in step 214, another player's hand is selected using the process described in step 212 above. A check is made to determine if all the players in the game have been assigned a hand 216. If the answer is FALSE 218, the process in step 214 is repeated until all players have been assigned a hand. If the answer is TRUE 220, the player's cards are assigned based off of each player's hand ranking 222.

In the preferred embodiment, once the hand rankings have been assigned to each player, each player is dealt his hand according to his pre-determined hand rank. In a poker game, such as 5 card poker, each player is dealt five cards with all but one of the cards facing downwards. Each player knows that the other players have a hand that is likely to be close in hand rank to his, making the game more interesting. After viewing his first card and the first card of the other players, each player now has the option of placing a bet on his hand or folding utilizing buttons on a video game or a touch screen display. After all players have either placed a bet or folded, the second card is turned over so each player knows what two of his cards are. Once again each player has the option of placing a bet or folding. This process is repeated until all cards are overturned. The player with the highest hand rank wins the game. Five card poker is described by way of example only. Numerous other card games may be played with this method. In an alternative embodiments, poker games which allow each player to choose to discard and replace cards in his hand or community cards can be shared among players.

FIG. 4*a* illustrates a first example of a game of five card stud with four players. Each player in the game is assigned a deviation multiplier based upon the rules of the game described with reference to FIG. 2. In this example, each player is assigned a deviation multiplier based upon the list of deviation multipliers in FIG. 3. Since four players are playing the poker game, the deviation multipliers randomly assigned to each of the four players are 1, 1, 2, 3. As FIG. 4*a* illustrates, player one was assigned a deviation multiplier of one, player two was assigned a deviation multiplier of two, player three was assigned a deviation multiplier of one and player four was assigned a deviation multiplier of three. Once a deviation multiplier has been assigned to each player, an initial hand rank is randomly selected. In this case, hand ranking 39 (3 of kind with 7) high was selected as the initial hand ranking.

Next, the initial hand ranking and the average deviation for each player are used to determine, as discussed with reference to FIG. 2, the hand ranking of each of the players. Player one has a deviation multiplier of one, so player one's hand rank is selected within the range of ±10 of the initial hand ranking, or 29 to 49 (2 pair 10 high to straight 7 high). Using the formula discussed above, a hand ranking of 30 (2 pair jack high) is selected for player one. Player two has a deviation multiplier of two, so player two's hand rank is selected as within the range of ±20 of the hand ranking, or 19 to 59 (pair of queens to flush 9 high). Using the formula above, a hand ranking of 43 (3 of a kind jack high) is selected for player two. Player three has a deviation multiplier of one, so player three's hand rank is selected as within the range of ±10 of the hand ranking, or 29 to 49 (2 pair 10 high to straight 7 high). Using the formula discussed above, a hand ranking of 33 (2 pair ace high) is selected for player three. Player four has a deviation multiplier of three, so player four's hand rank is selected as within the range of ±30 of the hand ranking, or 9 to 69 (pair 2s to full house 6 high). Using the formula discussed above, a hand ranking of 57 (flush 7 high) is selected for player four.

Therefore, as shown in FIG. 4*b,* player one's hand rank is 31 (2 pair queen high), player two's hand rank is 43 (3 of a kind jack high), player three's hand rank is 33 (2 pair ace high) and player four's hand rank is 57 (flush 7 high). As a result of this method, each of the four players has the possibility of having a hand rank that is close to the other players. None of the players know what the hand rank is of each of the other players, but knows that it is more likely to be a comparable hand rank than without a biased deal. Thus, a more exciting game has been created, assuming all players in the game do not fold. Player four would win this game. However, those skilled in the art of poker know the hand rankings are close, much closer than one would expect to see with a standard method of dealing. All the players in the game may be dealt their cards from a single deck of cards or each player may have his own, separate deck of cards. If separate decks of cards are used and two or more players end up with the same hand, the winner is determined by the suit of the cards. Prior to the beginning of the games, rules are established as to the rankings of the suits, such as hearts takes precedence of spades which takes precedence over diamonds which takes precedence over clubs. For example, if two players have the same straight flush with the exception of different suits, the highest ranking suit would win. If the first player had a straight flush in the suit hearts and the second player had a straight flush in the diamonds, the first player would win based upon the pre-established rules that hearts are ranked higher than diamonds.

FIG. 5*a* illustrates a second example of a card game (five card stud) with six players. Each player in the game is assigned a deviation multiplier based upon the rules of the game. In this example, each player is assigned a deviation multiplier based upon the table in FIG. 2. Since six players are playing the poker game, the average deviations will be 1, 1, 2, 2, 2, 3. These average deviations are randomly assigned to each of the six players. As FIG. 5*a* illustrates, player one was assigned a deviation multiplier of two, player two was assigned a deviation multiplier of one, player three was assigned a deviation multiplier of three, player four was assigned a deviation multiplier of one, player five was assigned a deviation multiplier of two and player six is assigned a deviation multiplier of two. Once a deviation multiplier has been assigned to each player, an initial hand rank was randomly selected. In this case, a hand ranking of 72 (full house 9 high) was selected.

Next the initial single hand rank and the average deviation for each player are used to select the hand that is dealt to each of the player. FIG. 5*b* illustrates the hand rank selected for each of the six players. Player one has a deviation multiplier of two, so player one's hand rank is selected as within the range of ±20 of the initial hand ranking, or 52 to 92 (straight 10 high to straight fl 6 high). Using the formula discussed above, a hand ranking of 66 (full house 3 high) is selected for player one. Player two has a deviation multiplier of one, so player two's hand rank is selected as within the range of ±10 of the hand ranking, or 62 to 82 (flush queen high to 4 of a kind 6 high). Using the formula discussed above, a hand ranking of 78 (4 of a kind 2 high) is selected for player two. Player three has a deviation multiplier of three, so player three's hand rank is selected as within the range of ±30 of the hand ranking, or 42 to 100 (3 of a kind 10 high to straight flush ace high). Using the formula discussed above, a hand ranking of 98 (straight flush queen high) is selected for player three. Player four has a deviation multiplier of one, so player four's hand rank is selected as within the range of ±10 of the hand ranking, or 62 to 82 (flush queen high to 4 of a kind 6 high). Using the formula discussed above, a hand ranking of 62 (flush queen high) is selected for player four. Player five has a deviation multiplier of two, so player four's hand rank is selected as within the range of 20 of the hand ranking, or 52 to 92 (straight 10 high to straight flush 6 high). Using the formula discussed above, a hand ranking of 77 (full house ace high) is selected for player five. Player six has a deviation multiplier of toe, so player four's hand rank is selected as within the range of 20 of the hand ranking, or 52 to 92 (straight 10 high to straight flush 6 high). Using the formula discussed above, a hand ranking of 60 (flush 10 high) is selected for player six.

Therefore, as shown in FIG. 5*b,* player one's hand rank is 66 (full house 3 high), player two's hand rank is 78 (4 of a kind 2 high), player three's hand rank is 98 (straight flush queen high), player four's hand rank is 62 (flush queen high), player five's hand rank is 77 (full house ace high) and player six's hand rank is 60 (flush 10 high). As a result of this method, each of the six players has the possibility of having a hand rank that is close to the other players. None of the players know what the hand rank is of each of the other players, but knows that it is more likely to be a comparable hand rank than without a biased deal. Thus, a more exciting game has been created. Once all the cards have been turned over, player three would win this game assuming all players in the game do not fold. However, those skilled in the art of poker know the hand rankings are close, much closer than one would expect to see with a standard method of dealing. All the players in the game may be dealt their cards from a single deck of cards or each player may have his own, separate deck of cards.

Although an exemplary embodiment of the invention has been described above by way of example only, it will be understood by those skilled in the field that modifications may be made to the disclosed embodiment without departing from the scope of the invention, which is defined by the appended claims.

We claim:

1. A method of playing a card game, the method comprising:

providing a device that performs the following steps:

randomly assigning a deviation multiplier to players in the card game;

randomly selecting an initial single hand rank, the initial single hand rank is utilized, along with the deviation multiplier, to determine a range of possible hand rankings for each of the players in the card game, each player is assigned a hand rank within the range of possible hand rankings;

randomly selecting a base number from the range of possible hand rankings;

assigning a hand rank to the each of the players in the game, where the hand rank is determined using the base number; and using the device to:

(a) deal a plurality of cards to the players face down;

(b) display a card for each of the players, the each of the players choosing to either bet or fold the hand;

(c) display another card for each of the players, the each of the players choosing to either bet or fold the hand;

(d) repeat step (c) for each additional player in the game; and (e) determine the highest ranking hand using all the displayed cards of the players who have not folded.

2. The method of claim 1, wherein each player is assigned a different hand ranking.

3. The method of claim 1, wherein a winning hand is determined by the highest ranking hand.

4. The method of claim 3, further comprising the steps of:

discarding a selected number of cards;

replacing the discarded cards; and determining the winner of the game based on the player with the highest ranking hand.

5. The method of claim 1, wherein the card game is five card stud.

6. The method of claim 1, further comprising the step of providing a video display in which to display each hand of the players.

7. The method of claim 1, wherein 5 cards are initially dealt to each player.

8. The method of claim 1, wherein the range is determined by a formula, wherein the formula is (10×the deviation multiplier)×2.

9. The method of claim 8, wherein a random number is selected from between 0 and the formula.

10. The method of claim 9, wherein the base number is the random number plus the initial single hand rank.

11. The method of claim 10, wherein the hand rank of each of the players is determined by subtracting (10×deviation multiplier) from the base number.

12. The method of claim 1, further comprising the step of dealing each of the players in the game the assigned hand rank and wherein each of the players in the game is dealt a hand from a different deck of cards.

* * * * *

UNITED STATES PATENT AND TRADEMARK OFFICE

CERTIFICATE OF CORRECTION

PATENT NO. : 7,624,987 B2
APPLICATION NO. : 11/348994
DATED : December 1, 2009
INVENTOR(S) : Campbell et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 724 days.

Signed and Sealed this

Twenty-sixth Day of October, 2010

David J. Kappos

David J. Kappos
*Director of the United States Patent and Trademark Office*